United States Patent [19]

Bethea

[11] 4,324,605

[45] Apr. 13, 1982

[54] TILING ARRANGEMENT AND METHOD

[75] Inventor: James R. Bethea, Denham Springs, La.

[73] Assignee: Noble Manufacturing Company, Baton Rouge, La.

[21] Appl. No.: 203,985

[22] Filed: Nov. 4, 1980

[51] Int. Cl.[3] ..... B32B 3/14; B32B 31/04

[52] U.S. Cl. ..... 156/247; 52/389; 156/299; 156/307.5; 156/307.7; 156/309.3; 156/313; 156/315; 428/49; 428/47

[58] Field of Search ..... 428/47, 44, 189, 49; 156/299, 307.5, 307.7, 309.3, 313, 315, 247; 52/384, 389, 390

[56] References Cited

U.S. PATENT DOCUMENTS 2,838,463 6/1958 Freeman ..... 260/3.5

3,970,502 7/1976 Turner ..... 156/310

*Primary Examiner*—Paul J. Thibodeau

*Attorney, Agent, or Firm*—Price, Heneveld, Huizenga & Cooper

[57] ABSTRACT

An arrangement and method for tiling bath enclosures, shower stalls, and the like, comprises providing a sheet of imperforate, substantially waterproof material with a dry, solvent-based film adhesive formed on the exterior side of the sheet. The interior side of the sheet is adhered to those substrate walls to be tiled, and tile adhesive is applied over the film adhesive on the exterior side of the sheet. The tile adhesive includes a solvent which partially dissolves the film adhesive, and a cross-linking agent which securely bonds the adhesives to each other and the waterproof sheet. Ceramic tiles are pressed into the wet adhesive, and are fixedly anchored in place as the adhesive cures, such that the waterproof sheet forms a barrier between the tiles and the substrate walls which is substantially impervious to moisture.

31 Claims, 5 Drawing Figures

TILING ARRANGEMENT AND METHOD

BACKGROUND OF THE INVENTION

The present invention relates to tiling, and in particular to an arrangement and method for mounting ceramic tiles and the like to a substrate, and forming a substantially waterproof barrier therebetween.

Glazed wall tiles, ceramic mosaic tile, quarry tile, paver tile, Defltware, marble, and other similar finishing materials are used in some types of building construction to cover the walls, floors, etc. of a building. The term "ceramic tile", as used herein, is intended to include all such materials. Such ceramic tiles provide a very durable, easily cleaned, attractive construction which will not weather or deteriorate even in areas of high heat and humidity. Hence, this type of building material is particularly adapted for use in bath enclosures, showers, and other similar applications and environments.

Heretofore, ceramic tile has been installed over a lath and plaster base. In one type of construction, a thick bed of mortar or cement, approximately 1½ inches thick, is applied over the lath and plaster, and water soaked ceramic tiles are pressed onto the cement base. As the moisture in the ceramic tiles evaporates, the mortar is pulled into the pores of the tiles to form a very secure bond.

Another prior method for installing ceramic tiles is known in the trade as the "thin set" method, and comprises applying a relatively thin layer of adhesive to the lath and plaster substrate into which the tiles are set. In the "thin set" method, the adhesive layer is approximately ⅛ to ¼ inches thick, and employs an adhesive such as Portland latex cement, epoxy, and/or some organic adhesives.

Ceramic tile, as well as the grout used to install the same are relatively porous with respect to water vapor. As a result, water vapor will penetrate the tiles and become absorbed in the cement or other adhesive, which eventually ruins the bond holding the tile to the substrate. Also, because the tiles and the grout are quite brittle, even slight structural shifting in the building walls can cause the grout and/or tiles to become dislodged. In either of the above events, the tile substrate is exposed to moisture, and ultimately causes the substrate to lose its structural integrity. As a result, plywood, wall board, and other such construction materials which are particularly susceptible to water damage are not generally used as a substrate for ceramic tile installations.

Presently, there are no known methods available for forming an effective waterproof shield between ceramic tile and supporting substrate, so as to insure the structural integrity and longevity of the construction, and/or permit the use of less expensive substrates in the installation process. Although some types of wall board have been provided with a paraffin wax coating on one side thereof to resist penetration of water vapor, such arrangements have proven not sufficiently waterproof to render them effective for most types of ceramic tile installations.

SUMMARY OF THE INVENTION

One aspect of the present invention is a method for forming a watertight barrier between ceramic tile or the like and a supporting substrate therefor, comprising providing a sheet of imperforate, substantially waterproof material, having a dry, solvent-based film adhesive on one side thereof. The other side of the waterproof sheet is adhered to the substrate, and a tile adhesive is applied over the film adhesive on the exterior side of the waterproof sheet. The tile adhesive includes a solvent which partially dissolves the film adhesive, and a cross-linking agent to chemically interlink the two adhesives and form a solvent weld which securely bonds the same to the waterproof sheet. Ceramic tiles are then pressed into the wet tile adhesive, and the adhesives are cured. Preferably, the tile adhesive comprises a mixture having a trowelable consistency which includes Portland cement and neoprene. Also, the waterproof sheet is preferably constructed of a chlorinated polyethylene which is flexible for conforming the sheet to the shape of the substrate.

Another aspect of the present invention is a method which is particularly adapted for installing ceramic tile in bathtub enclosures, shower stalls and the like, and comprises providing at least one sheet of imperforate substantially waterproof material having a dry, solvent-based film on the exterior side thereof, with a protective cover sheet thereover. The waterproof material is shaped to overlie each enclosure wall to be tiled, and an elastomer substrate adhesive is applied to each of side walls. The interior side of the waterproof material is pressed against the substrate adhesive, which is cured so as to securely bond the waterproof material to the building walls. The cover sheet on the exterior side of the waterproof material is then removed from the film adhesive, and a layer of elastomer tile adhesive is applied thereover. The tile adhesive includes a solvent which partially dissolves the film adhesive, as well as a cross-linking agent to securely bond the tile and film adhesives both to each other and the waterproof material. Ceramic tiles are then positioned in place, and pressed into the wet tile adhesive. When the adhesive cures, the tiles are securely mounted on the building walls, and the tiles are then grouted in a conventional manner. The imperforate sheet forms a substantially waterproof barrier between the tile and the substrate which prevents deterioration of the tile bond and the substrate.

Yet another aspect of the present invention is a water resistant, tiled panel arrangement, comprising a rigid substrate constructed of a material susceptible to moisture damage. A sheet of imperforate, substantially waterproof material is adhered to an exterior surface of the substrate, and includes a solvent-based film adhesive on the exterior side of the sheet. A thin set layer of tile adhesive overlies and is bonded to the film adhesive, and the ceramic tiles are embedded in the tile adhesive, and securely attached thereto in the cured adhesive state, such that the sheet forms a substantially waterproof barrier between the tiles and the substrate.

Yet another aspect of the present invention is a tile adhesive for mounting ceramic tile and the like on a substantially waterproof substrate having a film adhesive thereon. The tile adhesive comprises a mixture having a solvent-based elastomer with a solvent of the film adhesive therein for partially dissolving the film adhesive, and a cross-linking agent to securely interbond the tile and film adhesive and attach the same to the waterproof substrate. In one example, Portland cement mortar is mixed with the elastomer, and in another example, blown glass microspheres are mixed with the elastomer to render the mixture trowelable.

The principal objects of the present invention are to provide a substantially waterproof barrier between ceramic tile or the like, and a supporting substrate therefor. The barrier is sufficiently effective, so that plywood, wall board, and other materials susceptible to water damage can be used even in bathroom enclosures, shower stalls, and other similar applications and environments. The barrier is relatively easy to install, and avoids the time consuming, tedious lath and plaster substrate constructions. The waterproof barrier protects the substrate even when the grout between the edges of adjacent ceramic tiles has become dislodged. The barrier is retained in place by an adhesive layer which is preferably trowelable so as to conform with present thin set installation techniques. A film adhesive is applied to the exterior side of the barrier so as to securely bond the ceramic tiles to the wall.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
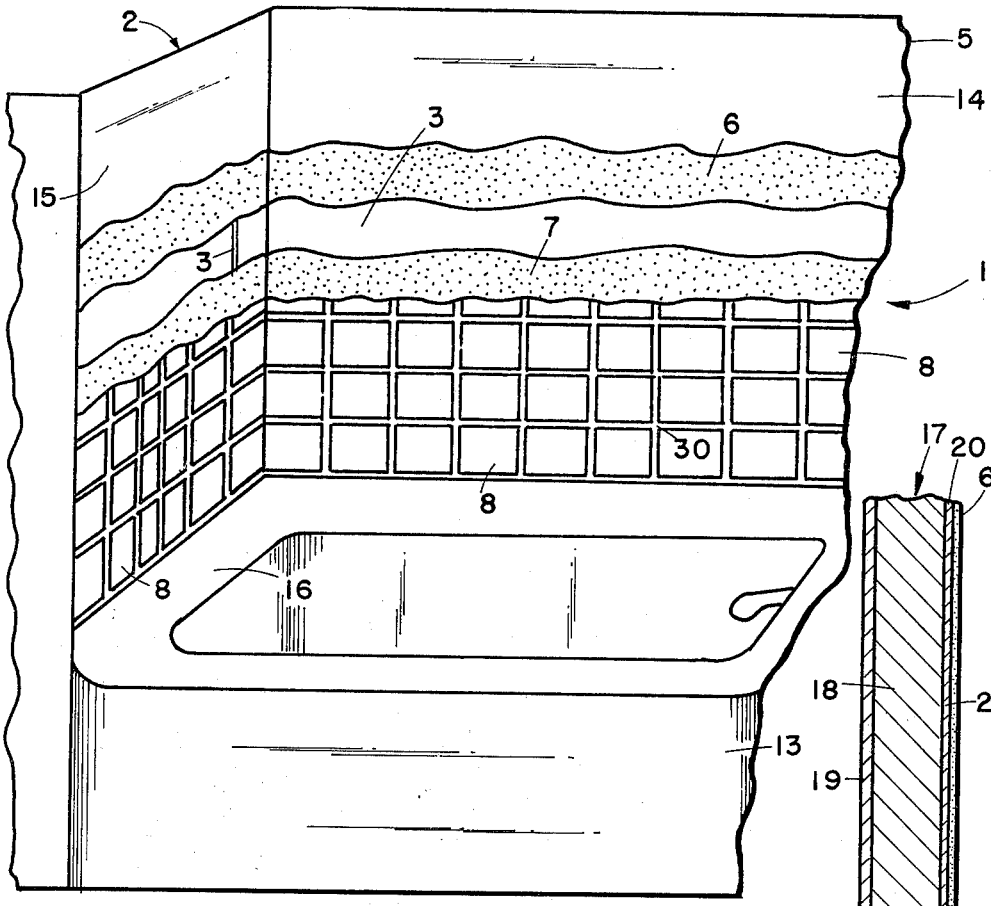
FIG. 1 is a fragmentary, partially schematic perspective view of a tiling arrangement and method embodying the present invention, shown in conjunction with a bathtub enclosure.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations and step sequences, except where expressly specified to the contrary.

The reference numeral 1 (FIG. 1) generally designates a ceramic tiling arrangement which is particularly adapted for use in high moisture environments, such as kitchens, laboratories, shower stalls, sinks, floors, and the illustrated bathtub enclosure 2. A sheet of imperforate, substantially waterproof material 3 is provided, and includes a dry, solvent-based film adhesive 4 (FIG. 2) formed on the exterior side of sheet 3. The interior side of sheet 3 (FIG. 1) is attached to the enclosure walls 5 by a layer of substrate adhesive 6. A thin set layer of tile adhesive 7 is applied over film adhesive 4 on the exterior side of waterproof sheet 3, and includes a solvent which partially dissolves film adhesive 4, as well as a cross-linking agent which securely bonds the substrate and tile adhesive 6 and 7 to each other and waterproof sheet 3. Ceramic tiles 8 are pressed into the wet layer of tile adhesive 7, and are fixedly anchored in place as the adhesive cures, such that waterproof sheet 3 forms a barrier between ceramic tiles 8 and the substrate walls 5 which is substantially impervious to moisture.

Figure 2:
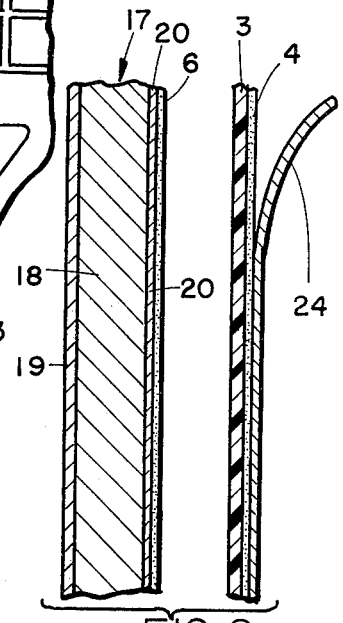
FIG. 2 is an enlarged, exploded, vertical cross-sectional view of a waterproof sheet and a substrate to which the sheet is to be attached.

The illustrated bath enclosure 3 has a conventional configuration, with bathtub 13 positioned in an inset in a building room defined by side and end walls 14 and 15 respectively. The enclosure walls 14 and 15 extend downwardly to meet the upper edge or rim 16 of tub 13, and extend upwardly therefrom to a position adjacent the ceiling of the room. Normally, bath enclosures are tiled only to a height equal to or slightly below the elevation of the shower head (not shown). Unlike conventional building constructions, bath enclosure walls 14 and 15 may be constructed of a material which is susceptible to moisture damage such as plywood, or the illustrated dry wall or wall board 17, which as best illustrated in FIG. 2, includes a plaster core 18 covered by two plies 19 and 20 of cellulous material on the interior and exterior side respectively of wall board 17. The tiling arrangement 1 is also particularly adapted for use in conjunction with other types of substrates, such as Celotex, cinder block, cement, Wonderboard, gypsum, and the like, where moisture penetration destroys the bond between the ceramic tile 8 and the substrate.

Waterproof sheet 3 is imperforate, and substantially impermeable to moisture, including water vapor. Preferably, sheet 3 is a membrane, constructed of a relatively thin, flexible sheet of chlorinated polyethylene, which can be easily cut to size, and will conform with the shape of the substrate. A thickness in the range of 10 to 20 mills has been found satisfactory for the illustrated bath enclosure type of application.

Waterproof sheet 3 is provided with a pre-formed film adhesive 4 on the exterior surface thereof, which is adapted to insure proper bonding of tile adhesive 7 and ceramic tiles 8 to waterproof sheet 3. It is contemplated that film adhesive 4 would be formed on sheet 3 at the cite of manufacture, and a cover sheet 24 is provided over film adhesive 4 to protect the same prior to use. Film adhesive 4 is preferably formed from a solvent-based elastomer, such as neoprene. One example of a suitable neoprene adhesive comprises a mixture, including the following elements and proportions.

EXAMPLE 1

| Ingredient | PHR | (Parts per Hundred Resin) |
|---|---|---|
| High crystalline neoprene (gell type), such as that known in the trade as Baypren 321 or Type CG | 50 | |
| A lower molecular weight neoprene, such as that known in the trade as Baypren 233 or Type AG | 50 | |
| Magnesium oxide | 4 | |
| Zinc oxide (active) | 4 | |
| Chlorinated natural rubber, such as that known in the trade as Pergut S-40 | 5 | |

The neoprenes are first masticated, and then dissolved in a solvent, such as the following example.

EXAMPLE 2

| Ingredient | Parts By Volume |
|---|---|
| Ethyl acetate | 2 |

-continued

| Ingredient | Parts By Volume |
|---|---|
| Petroleum naptha (BP 65–95° C.) | 2 |
| Toluene | 1 |

Film adhesive 4 is formed on the exterior side of sheet 3 by spreading the above neoprene solution thereover in a conventional fashion, thereby forming a smooth, substantially continuous layer having a substantially uniform thickness, in the nature of 0.0003 inches. The coated sheet 3 is preferably flexible so that it can be easily molded over the substrate, and is readily trimmed to size by shears, or other conventional cutting instruments. In the installation of tiling arrangement 1, waterproof sheets 3 are cut to cover each substrate wall, such as the illustrated bathtub enclosure walls 14 and 15. Preferably, the waterproof sheets 3 are cut and applied to the substrate in a manner which covers any joints in the substrate, such as the corner joint between walls 14 and 15 shown in FIG. 1.

Waterproof sheet 3 is preferably adhered to wall board 17 by applying a layer of substrate adhesive 6 over the exterior ply 20 of the wall board. Preferably, substrate adhesive 6 is solvent-based, and identical with the solution set forth above in Examples 1 and 2, except that after all ingredients have reached solution, the entire system is cross-linked by the introduction of an isocynate, such as that known in the trade as Desmonder R. The isocynate is preferably mixed with the solution in the following proportion.

EXAMPLE 3

| Ingredient | Percentage By Volume |
|---|---|
| Neoprene solution | 90 |
| Isocynate | 10 |

The above noted cross-linked solution is believed to be marketed in the United States by Tip Top Adhesives, Inc., under the trade name SC-2000. The neoprene adhesive solution is quite flowable, and is applied to the interior side of wall board 17 by means such as painting, either brush, roller or spray, so as to form a substantially uniform layer, which is relatively thin, in the nature of less than 0.010 of an inch.

Before substrate adhesive layer 6 cures, the interior side of waterproof sheet 3 is pressed against the wall board, so as to adhere the same thereto. Sheet 3 may be rolled against wall board 17 so as to insure continuous contact, and eliminate any lumps or bubbles, in a manner similar to the application of wallpaper. Substrate adhesive 6 is then fully cured. In the above example, the adhesive preferably cures in less than one hour, so as to permit the ceramic tiles to be set in place without undue delay.

After waterproof sheet 3 is fixedly adhered to wall board 17, cover sheet 24 is peeled or otherwise removed from the exterior side of sheet 3 to expose film adhesive 4. Tile adhesive 7 is then mixed and applied over film adhesive 4. Preferably, tile adhesive 7 is sufficiently liquid or flowable that it can be applied by a trowel, in a manner similar to present thin set techniques for applying ceramic tiles. Tile adhesive 7 is preferably a mixture comprising Portland cement mortar, neoprene adhesive, and an isocynate to insure a strong bond with film adhesive 4 and sheet 3. One example of a suitable tile adhesive mixture is provided below.

EXAMPLE 4

| Ingredient | Parts By Volume |
|---|---|
| Portland cement mortar | 2 |
| Neoprene adhesive plus 10% isocynate | 1–5 |

Acrylic latex may also be added to the mixture, and one example of this arrangement is as follows.

EXAMPLE 5

| Ingredient | Parts By Volume |
|---|---|
| Portland cement mortar, such as that known in the trade as Kaiser 500 | 2 |
| Acrylic latex, such as that known in the trade as H.B. Fuller Acrylbond | 2 |
| Neoprene adhesive plus 10% isocyante | 1 |

Figure 3:
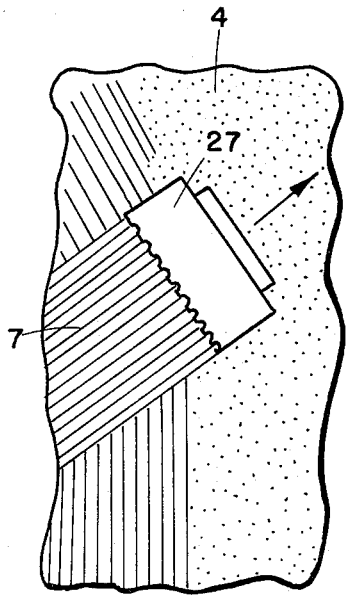
FIG. 3 is a partially schematic, front elevational view of the substrate showing the trowel application of a tile adhesive over a film adhesive on the exterior side of the sheet.

The tile adhesive mixture 7 is then manually applied over film adhesive 4, by means such as notched hand trowel 27 as shown in FIG. 3, to form a thickness in the nature of $\frac{1}{8}$ to $\frac{1}{4}$ of an inch.

Another suitable tile adhesive mixture does not include Portland cement mortar, but instead includes blown glass bubbles or microspheres which render the neoprene trowelable. Such adhesives are preferably formulated in accordance with the following proportions.

EXAMPLE 6

| Ingredient | Parts By Volume |
|---|---|
| Neoprene | 100 |
| Blown glass microspheres | 5–50 |

The neoprene may be provided with a cross-linking agent, such as silane, to increase the bond strength between the glass and the neoprene. The glass microspheres may be coated.

Figure 4:
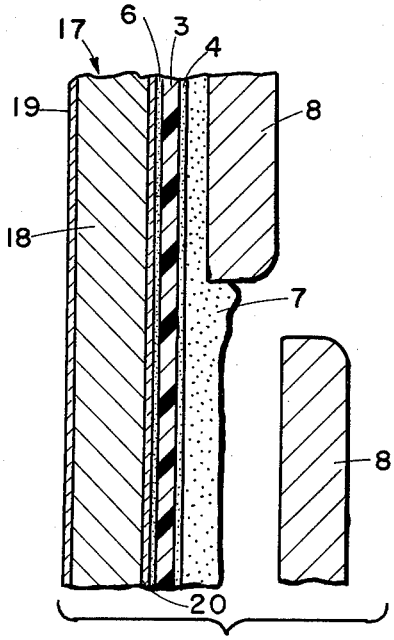
FIG. 4 is an enlarged, partially schematic, exploded vertical cross-sectional view of the tile arrangement, with the upper tile pressed into the tile adhesive.
Figure 5:
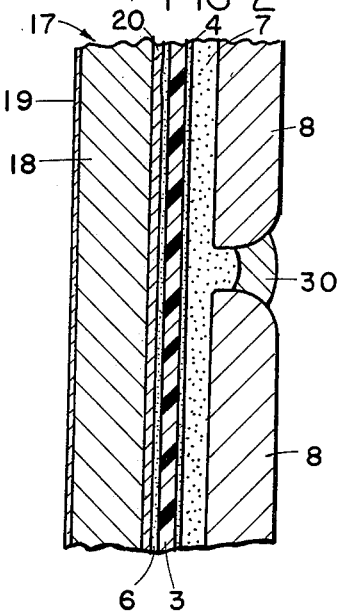
FIG. 5 is an enlarged, partially schematic, vertical cross-sectional view of the tile arrangement shown in FIG. 4, with both tiles set in place, and grout installed between adjacent side edges of the tiles.

The ceramic tiles 8 are then set by hand into the uncured tile adhesive 7, as shown in FIG. 4, in a substantially conventional fashion, wherein the tile is pressed firmly against the wall, sinking it slightly into the wet adhesive. After all of the tiles have been pressed into place, tile adhesive 7 is allowed to fully cure, which in the above example, takes approximately 25–40 hours. The isocynate imparts a chemical cure to adhesive layers 4 and 7, as well as a chemical cross-link and a solvent weld between the same. After tile adhesive 7 is fully cured, the gaps formed between adjacent side edges of the ceramic tiles 8 are filled with grout 30 by using conventional methods.

Waterproof sheet 3 provides a substantially water impervious barrier between ceramic tiles 8 and the substrate walls. The barrier is sufficiently effective to permit the use of building construction materials, such as plywood and wall board, which are highly susceptible to water damage, and at the same time, avoids using timely and costly conventional lath and plaster techniques. Sheet 3 provides a continuous water barrier across the entire substrate, such that even direct contact with moisture, such as that encountered when grout falls out between the tiles, will not cause damage to the substrate. The tile adhesive 7 trowelable, so as to conform with present thin set installation techniques, and provides a secure bond to adhere the ceramic tiles to sheet 3.

It is to be understood that while certain specific forms and examples of the present invention are illustrated and described herein, the invention is not to be limited to the specific examples noted hereinabove. Further, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A method for forming a watertight barrier between ceramic tile and a supporting substrate therefor, comprising:

providing a sheet of imperforate, substantially waterproof material having a dry, solvent-based film adhesive on one side thereof;

adhering the other side of said waterproof sheet to said substrate;

applying a tile adhesive over the film adhesive on said waterproof sheet one side; said tile adhesive having a solvent of said film adhesive therein for partially dissolving said film adhesive, and a cross-linking agent to interlink said tile and film adhesives and securely bond the same to said waterproof sheet;

pressing said ceramic tile into said tile adhesive; and curing said adhesives.

2. A method as set forth in claim 1, wherein:

said tile adhesive comprises a mixture having a trowelable consistency, and including Portland cement; and said tile adhesive applying step comprises manually troweling a thin set adhesive layer onto said sheet.

3. A method as set forth in claim 2, wherein said tile adhesive mixture further includes neoprene.

4. A method as set forth in claim 2, wherein:

said film adhesive comprises a mixture which includes neoprene.

5. A method as set forth in claim 2, wherein:

said pressing step comprises manually setting said ceramic tile into said thin set adhesive layer.

6. A method as set forth in claim 1, wherein said adhering of said waterproof sheet to said substrate comprises:

applying a thin coat of substrate adhesive to said substrate;

pressing the other side of said waterproof sheet against the adhesive coated side of said substrate; and curing said substrate adhesive.

7. A method as set forth in claim 6, wherein:

said substrate adhesive comprises a mixture including a dissolved, flowable neoprene with a cross-linking agent therein:

said substrate adhesive applying step comprises manually spreading said substrate adhesive over said substrate; and said curing of said substrate adhesive is a chemical cure.

8. A method as set forth in claim 7, wherein:

said film adhesive is a mixture which includes neoprene.

9. A method as set forth in claim 8, wherein:

said film adhesive mixture is identical with said substrate adhesive mixture less said cross-linking agent.

10. A method as set forth in claim 9, wherein:

said tile adhesive comprises a mixture having a trowelable consistency, and including Portland cement; and said tile adhesive applying step comprises manually troweling a thin set adhesive layer onto said sheet.

11. A method as set forth in claim 10, wherein said tile adhesive mixture further includes neoprene.

12. A method as set forth in claim 1 or 11, wherein:

said waterproof sheet is constructed of chloroinated polyethylene, and is flexible for conforming said sheet to the shape of said substrate.

13. A method as set forth in claim 12, wherein both of said neoprene adhesive mixtures have the following composition:

| | PHR |
|---|---|
| High crystalline neoprene | 50 |
| Low molecular weight neoprene | 50 |
| Magnesium oxide | 4 |
| Zinc oxide (active) | 4 |
| Chlorinated natural rubber | 5 |

14. A method as set forth in claim 13, wherein:

said neoprenes are masticated and dissolved in a mixture comprising:

| | Parts Per Volume |
|---|---|
| Ethyl acetate | 2 |
| Petroleum naptha | 2 |
| Toluene | 1 |

15. A method as set forth in claim 14, wherein:

said dissolved neoprenes for said substrate adhesive are cross linked by introduction of 10% by volume of said cross-linking agent.

16. A method as set forth in claim 15, wherein:

said cross-linking agent comprises isocyanate.

17. A method as set forth in claim 16, wherein said tile adhesive mixture has the following composition:

| | Parts By Volume |
|---|---|
| Portland cement mortar | 2 |
| Acrylic latex | 2 |
| Neoprene adhesive with 10% by volume isocynate | 1 |

18. A method for adhering ceramic tile and the like to an imperforate, substantially waterproof material, comprising:

applying a solvent based elastomer adhesive to that side of said material to which said tile is to be adhered;

drying said adhesive to form a film;

applying an adhesive over said dried film adhesive, wherein said second named adhesive includes a solvent of said film adhesive for partially dissolving said film adhesive, and a cross-linking agent to securely bond said first and second named adhesives to said waterproof material;

pressing a ceramic tile into said second adhesive; and
curing said first and second named adhesives.

19. A method as set forth in claim 18, wherein:
said waterproof material comprises a sheet of chlorinated polyethylene.

20. A method as set forth in claim 19, wherein:
said first and second named adhesives are both a mixture which includes neoprene.

21. A method as set forth in claim 20, wherein:
said second named adhesive further includes a Portland cement and has a flowable consistency; and
said second named adhesive applying step comprises manually troweling a thin set adhesive layer over the film adhesive on said waterproof material.

22. A method for mounting ceramic tile on a building wall, comprising:
providing a sheet of imperforate, substantially waterproof material shaped to cover the building wall, and having a dry, solvent-based, film adhesive on one side thereof;
applying an elastomer adhesive to the building wall;
pressing the other side of said waterproof sheet onto said adhesive;
curing said adhesive, thereby bonding said waterproof sheet to the building wall;
applying an elastomer adhesive over the film adhesive on said waterproof sheet one side; said second named adhesive including a solvent of said film adhesive therein for partially dissolving said film adhesive, and a cross-linking agent to securely bond said first and second named adhesives to said waterproof sheet;
pressing said ceramic tile into said second adhesive; and
curing said first and second named adhesives.

23. A method as set forth in claim 22, wherein:
said second named adhesive applying step comprises troweling a thin set adhesive layer over the film adhesive on said waterproof material one side.

24. A method as set forth in claim 23, wherein:
said second named adhesive includes Portland cement mortar, and is manually troweled to a thickness in the range of $\frac{1}{8}$–$\frac{1}{4}$ inches.

25. A method for installing ceramic tile in bathtub enclosures, shower stalls, comprising:
providing at least one sheet of imperforate, substantially waterproof material, having a dry, solvent-based film adhesive on one side thereof with a protective cover sheet thereover;
shaping said waterproof material to overlie each enclosure wall to be tiled;
applying an elastomer substrate adhesive to each of said enclosure walls to be tiled;
pressing the other side of said waterproof material against the substrate adhesive on each of said enclosure walls to be tiled;
curing said substrate adhesive, thereby bonding said waterproof material to said building walls;
removing the cover sheet from the material adhered to said building walls;
applying an elastomer tile adhesive over the film adhesive on said waterproof material one side; said tile adhesive including a solvent of said film adhesive therein to partially dissolve said film adhesive, and a cross-linking agent to securely bond said tile and film adhesives to said waterproof material;
pressing said ceramic tile into said tile adhesive;
curing said tile and film adhesives to mount said ceramic tile on said building walls and form a substantially waterproof barrier therebetween; and
grouting the ceramic tiles mounted on said building walls.

26. A method as set forth in claim 25, wherein:
said substrate adhesive applying step comprises manually flowing said substrate adhesive onto said walls by painting.

27. A method as set forth in claim 25, wherein:
said waterproof material shaping step comprises manual cutting.

28. A method as set forth in claim 25, wherein:
said waterproof material pressing step comprises rolling said waterproof material against said substrate to insure continuous contact and to remove lumps and bubbles.

29. A method as set forth in claim 25, wherein:
said tile adhesive comprises a flowable mixture which includes Portland cement; and
said tile adhesive applying step comprises troweling a thin set adhesive layer over said film adhesive on said waterproof material.

30. A method as set forth in claim 25, wherein:
said tile pressing step comprises manually setting said ceramic tile in said tile adhesive.

31. A method as set forth in claim 25, wherein:
said substrate adhesive applying step comprises manually flowing said substrate adhesive onto said walls by painting;
said waterproof material shaping step comprises manual cutting;
said waterproof material pressing step comprises rolling said waterproof material against said substrate to insure continuous contact and to remove lumps and bubbles;
said tile adhesive comprises a flowable mixture which includes Portland cement;
said tile adhesive applying step comprises troweling a thin set adhesive layer over said film adhesive on said waterproof material; and
said tile pressing step comprises manually setting said ceramic tile in said tile adhesive.

* * * * *

UNITED STATES PATENT AND TRADEMARK OFFICE

CERTIFICATE OF CORRECTION

PATENT NO. : 4,324,605

DATED : April 13, 1982

INVENTOR(S) : James R. Bethea

It is certified that error appears in the above—identified patent and that said Letters Patent is hereby corrected as shown below:

Column 4, line 39:
"cite" should be --site--

Column 4, line 51:
"gell" should be --gel--

Column 7, line 3:
after "7" insert --is--

Column 8, Claim 16, line 45:
"isocyanate" should be --isocynate--

Signed and Sealed this

*Twenty-sixth* Day of *April 1983*

[SEAL]

*Attest:*

GERALD J. MOSSINGHOFF

*Attesting Officer*

*Commissioner of Patents and Trademarks*